US009533523B2

(12) United States Patent
Einhorn et al.

(10) Patent No.: US 9,533,523 B2
(45) Date of Patent: Jan. 3, 2017

(54) REFLECTIVE FEATURES WITH CO-PLANAR ELEMENTS AND PROCESSES FOR MAKING THEM

(71) Applicant: SICPA HOLDING SA, Prilly (CH)

(72) Inventors: Richard Einhorn, Albuquerque, NM (US); Mark Hampden-Smith, Billerica, MA (US); Miodrag Oljaca, Billerica, MA (US); Jainisha Shah, Rio Rancho, NM (US)

(73) Assignee: SICPA HOLDING SA, Prilly (CH)

( * ) Notice: Subject to any disclaimer, the term of this patent is extended or adjusted under 35 U.S.C. 154(b) by 20 days.

(21) Appl. No.: 14/086,653

(22) Filed: Nov. 21, 2013

(65) Prior Publication Data

US 2015/0138270 A1 May 21, 2015
US 2015/0251471 A9 Sep. 10, 2015

Related U.S. Application Data

(62) Division of application No. 11/443,264, filed on May 31, 2006, now abandoned.

(51) Int. Cl.

| | |
|---|---|
| ***B41M 3/14*** | (2006.01) |
| ***B44F 1/12*** | (2006.01) |
| ***B41M 5/00*** | (2006.01) |
| ***B41J 2/04*** | (2006.01) |

(52) U.S. Cl.
CPC . *B41M 3/14* (2013.01); *B41J 2/04* (2013.01); *B41M 5/0023* (2013.01)

(58) Field of Classification Search
CPC ..... B41M 3/14; B41M 3/148
USPC ..... 427/7
See application file for complete search history.

(56) References Cited

U.S. PATENT DOCUMENTS

| | | | |
|---|---|---|---|
| 4,434,010 | A | 2/1984 | Ash |
| 4,504,084 | A | 3/1985 | Jauch |
| 4,539,041 | A | 9/1985 | Figlarz et al. |
| 4,588,212 | A | 5/1986 | Castagnoli |
| 4,705,356 | A | 11/1987 | Berning et al. |
| 4,779,898 | A | 10/1988 | Berning et al. |

(Continued)

FOREIGN PATENT DOCUMENTS

| | | |
|---|---|---|
| DE | 4432062 | 4/2008 |
| EP | 0194042 | 9/1986 |

(Continued)

OTHER PUBLICATIONS

Kamyskyny et al. Ink-Jet Printing of Metallic Nanoparticles and Microemulsions, Macromolecular Rapid Communications, 2005, 26 pp. 281-288.*

(Continued)

*Primary Examiner* — Kelly M Gambetta
(74) *Attorney, Agent, or Firm* — Greenblum & Bernstein, P.L.C.

(57) ABSTRACT

The invention relates to a reflective feature, e.g., reflective security feature or reflective decorative feature, comprising a first element at least partially coplanar with a second element. The first element causes incident light to be reflected with a first intensity that varies as the angle of incidence changes relative to a surface of the reflective feature. The invention also relates to a direct write printing process for forming such a reflective feature from an ink comprising metallic nanoparticles.

21 Claims, 3 Drawing Sheets

(56) References Cited

U.S. PATENT DOCUMENTS

| | | | | |
|---|---|---|---|---|
| 5,059,245 | A | 10/1991 | Phillips et al. | |
| 5,278,590 | A | 1/1994 | Phillips et al. | |
| 5,304,587 | A | 4/1994 | Oswald et al. | |
| 5,324,567 | A | 6/1994 | Bratchley et al. | |
| 5,424,119 | A | 6/1995 | Phillips et al. | |
| 5,498,283 | A | 3/1996 | Botros et al. | |
| 5,569,535 | A | 10/1996 | Phillips et al. | |
| 5,695,220 | A | 12/1997 | Phillips | |
| 5,718,754 | A | 2/1998 | Macpherson et al. | |
| 5,720,801 | A | 2/1998 | Nadan et al. | |
| 5,722,693 | A * | 3/1998 | Wicker | B42D 25/29 283/67 |
| 5,766,738 | A | 6/1998 | Phillips et al. | |
| 5,853,464 | A | 12/1998 | Macpherson et al. | |
| 5,889,083 | A | 3/1999 | Zhu | |
| 5,944,881 | A | 8/1999 | Mehta et al. | |
| 5,980,593 | A | 11/1999 | Friswell et al. | |
| 6,013,307 | A | 1/2000 | Hauser et al. | |
| 6,114,018 | A | 9/2000 | Phillips et al. | |
| 6,296,281 | B1 | 10/2001 | Stone | |
| 6,712,894 | B2 | 3/2004 | Shepard | |
| 6,903,850 | B2 | 6/2005 | Kay et al. | |
| 6,905,755 | B1 | 6/2005 | Nemeth | |
| 6,937,752 | B2 | 8/2005 | Chiba et al. | |
| 6,938,013 | B1 | 8/2005 | Gutierrez-Sheris | |
| 6,972,138 | B2 | 12/2005 | Heinrich et al. | |
| 6,979,499 | B2 | 12/2005 | Walck et al. | |
| 7,749,299 | B2 | 7/2010 | Vanheusden et al. | |
| 7,963,646 | B2 * | 6/2011 | Magdassi et al. | 347/100 |
| 2002/0041047 | A1 | 4/2002 | Josephy et al. | |
| 2003/0148024 | A1 * | 8/2003 | Kodas | C23C 18/06 427/125 |
| 2004/0182533 | A1 | 9/2004 | Blum et al. | |
| 2004/0195823 | A1 | 10/2004 | Yokote et al. | |
| 2004/0233463 | A1 | 11/2004 | Hersch et al. | |
| 2005/0064157 | A1 | 3/2005 | Okazawa et al. | |
| 2005/0074611 | A1 | 4/2005 | Kuehnle et al. | |
| 2005/0078158 | A1 | 4/2005 | Magdassi et al. | |
| 2005/0170259 | A1 | 8/2005 | Holmes | |
| 2005/0192888 | A1 | 9/2005 | Lennane et al. | |
| 2005/0258637 | A1 | 11/2005 | Bi et al. | |
| 2005/0271566 | A1 | 12/2005 | Yadav | |
| 2005/0284366 | A1 | 12/2005 | Anderson et al. | |
| 2006/0083694 | A1 | 4/2006 | Kodas et al. | |
| 2006/0130700 | A1 * | 6/2006 | Reinartz | B41M 5/0023 106/31.92 |
| 2006/0159603 | A1 | 7/2006 | Vanheusden et al. | |
| 2006/0159838 | A1 | 7/2006 | Kowalski et al. | |
| 2006/0160373 | A1 | 7/2006 | Kowalski et al. | |
| 2006/0162497 | A1 | 7/2006 | Kodas et al. | |
| 2006/0166057 | A1 | 7/2006 | Kodas | |
| 2006/0189113 | A1 | 8/2006 | Vanheusden et al. | |
| 2007/0096057 | A1 | 5/2007 | Hampden-Smith et al. | |
| 2007/0190298 | A1 * | 8/2007 | Hampden-Smith et al. | 428/204 |
| 2007/0278422 | A1 * | 12/2007 | Einhorn et al. | 250/462.1 |
| 2007/0279718 | A1 * | 12/2007 | Einhorn et al. | 359/2 |
| 2007/0281177 | A1 * | 12/2007 | Haubrich et al. | 428/457 |

FOREIGN PATENT DOCUMENTS

| | | | |
|---|---|---|---|
| EP | 0642933 | 3/1995 | |
| EP | 1132450 | 9/2001 | |
| EP | 1335217 | 8/2003 | |
| EP | 1407824 | 4/2004 | |
| EP | 1422070 | 5/2004 | |
| EP | 1299250 | 4/2005 | |
| EP | 1609441 | 12/2005 | |
| WO | 90/02658 | 3/1990 | |
| WO | 90/08046 | 7/1990 | |
| WO | 99/48697 | 9/1999 | |
| WO | 00/24580 | 5/2000 | |
| WO | 03/038002 | 5/2003 | |
| WO | 2005/009753 | 9/2004 | |
| WO | 2005/070693 | 8/2005 | |
| WO | 2005/080089 | 9/2005 | |
| WO | 2005/123272 | 12/2005 | |
| WO | WO 2005120847 A1 * | 12/2005 | B41J 11/0015 |
| WO | 2006/013352 | 2/2006 | |
| WO | 2005/052500 | 5/2006 | |
| WO | 01/66360 | 4/2008 | |

OTHER PUBLICATIONS

Fuller et al. Ink-Jet Printed Nanoparticle Microelectromechanical Systems, Journal of Microelectromechanical Systems, Feb. 2002, vol. 11 No. 1, pp. 54-60.*

International Search Report and Written Opinion received in the corresponding International Application No. PCT/US2007/070164.

C&EN: Cover Story—Rainbow in a Can, CENEAR vol. 81, No. 44, pp. 25-27 (Nov. 3, 2003) (ISSN 0009-2347).

Smith, H., High Performance Pigments, Wiley-VCH Verlag-GmbH, Weinheim, Germany (2002).

Silvert, P.-Y. etal., "Preparation of colloidal silver dispersions by the polyol process" Part 1—Synthesis and characterization, *J. Mater. Chem.*, (1996), 6(4). pp. 573-577, and Part 2—Mechanism of particle formation, *J. Mater. Chem.*, (1997), 7(2), pp. 293-299.

Pond, S., "Inkjet Technology and Product Development Strategies," *Torrey Pines Research* (2000), pp. 115-122.

van Renesse, R., *Optical Document Security*, 3rd Edition, ARTECH House (ISBN 1-58053-6), Sections 4.2.6, 6.12, 7.1.3.

* cited by examiner

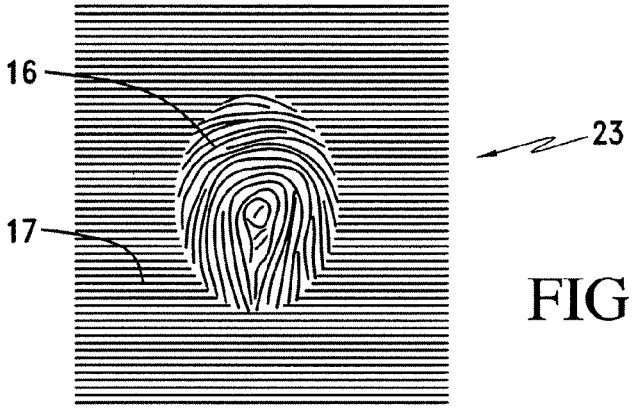
FIG. 3
FIG. 4
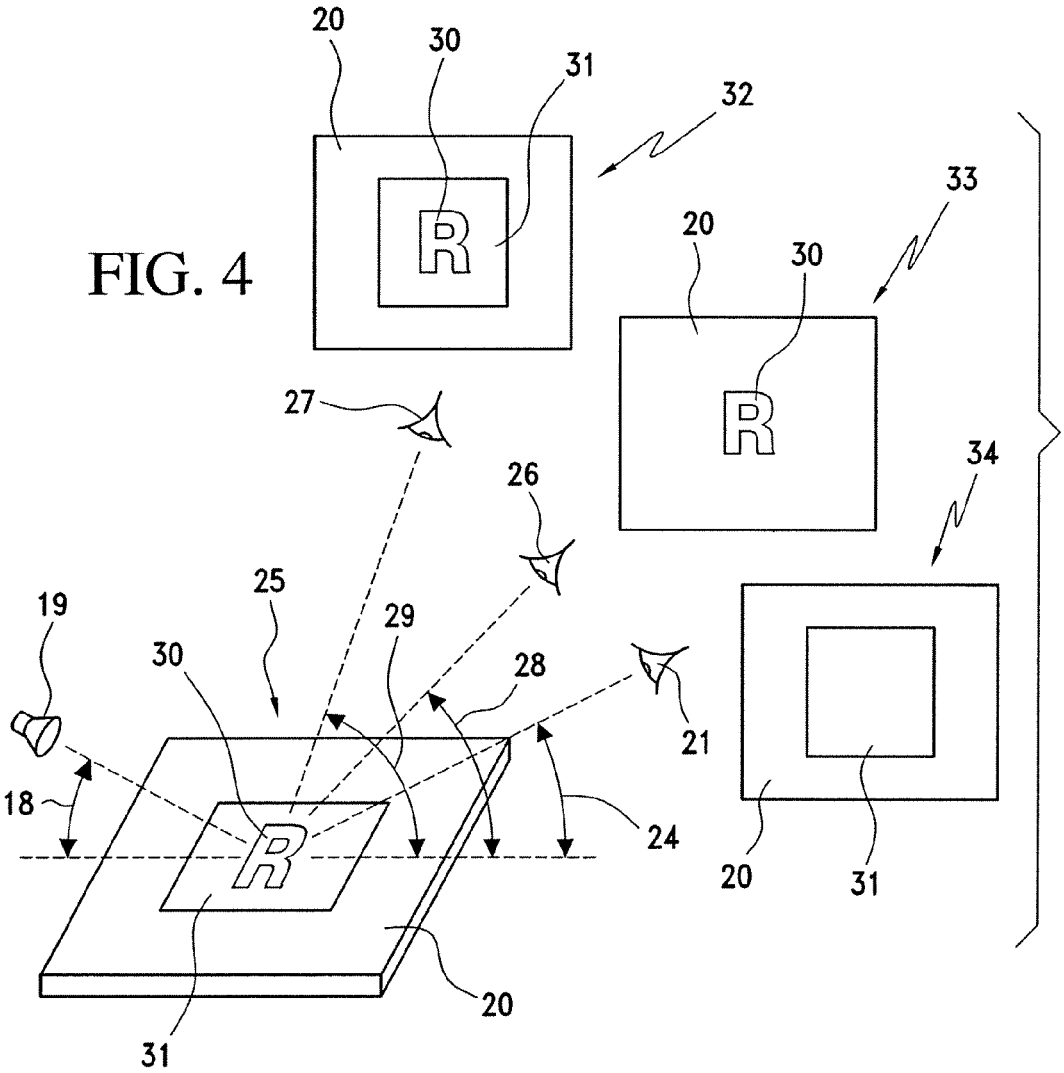

REFLECTIVE FEATURES WITH CO-PLANAR ELEMENTS AND PROCESSES FOR MAKING THEM

CROSS-REFERENCE TO RELATED APPLICATION

This application is a divisional of and claims priority to U.S. application Ser. No. 11/443,264, filed on May 31, 2006, hereby incorporated by reference in its entirety.

FIELD OF THE INVENTION

The present invention relates to reflective features and to processes for making reflective features. In particular, the invention relates to reflective features comprising co-planar elements, which preferably exhibit variable reflectivity, and which may be useful as reflective security features or reflective decorative features.

BACKGROUND OF THE INVENTION

Recent advances in color copying and printing have put increasing importance on developing new methods to prevent forgery of security documents such as banknotes. While there have been many techniques developed, one area of increasing interest is in developing security features that cannot be readily reproduced, particularly by a color copier or printer.

One approach that has been taken is to formulate an ink for creating a printed image that is visually distinct from its reproduction. For example, U.S. Pat. Nos. 5,059,245, 5,569,535, and 4,434,010, the entireties of which are incorporated herein by reference, describe the use of stacked thin film platelets or flakes. Images produced with these pigments exhibit angular metamerism. These pigments have been incorporated into security inks used, for example, in paper currency. These pigments have also been incorporated into plastics applications (see, for example, PCT Publication WO 00/24580, published May 4, 2000). Additional inks and security features are described in U.S. Pat. Nos. 4,705,356; 4,779,898; 5,278,590; 5,766,738; and 6,114,018, the entireties of which are incorporated herein by reference.

U.S. Pat. No. 6,013,307, the entirety of which is incorporated herein by reference, discloses a printing ink that contains a single dye or mixture of at least two dyes that is formulated in order to create the greatest possible metamerism between the formulated ink and a reference ink on the basis of two defined types of illumination. The original image is described as having visually clearly identifiable differences compared to its copy.

Another approach used to produce security documents has been to produce a "covert" image that contains a material which cannot be seen by the naked eye but which can be made visible under specific conditions. For example, U.S. Pat. Nos. 5,324,567, 5,718,754, and 5,853,464 disclose the use of Raman active compounds. U.S. Pat. Nos. 5,944,881 and 5,980,593 describe fluorescent materials that can be used in an ink. Also, U.S. Pat. No. 4,504,084 discloses a document containing an information marking comprised of a first color that is at least partially opaque or visible in infrared light and a second color, which conceals the first color in the visible spectrum, but is invisible to infrared light.

Inks that change upon chemical exposure have also been used for security documents. For example, U.S. Pat. Nos. 5,720,801, 5,498,283, and 5,304,587 disclose ink compositions that are invisible when printed, and develop a color upon exposure to bleach.

While these efforts afford printed images that are difficult to reproduce, advances in color copiers and color printers continue to be made. Therefore, a need remains for features and for processes for forming such features, particularly for security documents, which cannot be easily reproduced, and which are visually distinct from their reproductions.

Additionally, the need exists for providing the ability to create security features that display variable information, e.g., information that is individualized for a specific product unit, such as a serial number, which variable information cannot be easily or readily duplicated or copied. The need also exists for providing the ability to create security features displaying variable information and having high resolution at commercially acceptable rates.

SUMMARY OF THE INVENTION

In one embodiment, the invention is to a reflective feature, e.g., a reflective security feature or a reflective decorative feature, comprising a first element at least partially coplanar with a second element, wherein the first element causes incident light to be reflected with a first intensity that varies as the angle of incidence changes relative to a surface of the reflective feature. Preferably, the second element causes the incident light to be reflected with a second intensity that varies as the angle of incidence changes relative to the surface of the reflective feature. The variance of the first intensity optionally is different than the variance of the second intensity. The reflective feature optionally has a thickness of less than about 100 nm. The feature preferably comprises metallic nanoparticles. For example, the first element and/or the second element optionally comprises metallic nanoparticles.

Optionally, at least one of the first element or the second element forms an image. For example, at least one of the first element and/or the second element optionally forms an image of a fingerprint, barcode or a personal image. Optionally, at least one of the first element or the second element comprises variable information. At least one of the first element or the second element optionally comprises microprint.

Optionally, the first element is visible when viewed from a first angle, and the second element is at least partially obscured when viewed from the first angle. In this aspect, the first element optionally is at least partially obscured when viewed from a second angle, and the second element is visible when viewed from the second angle. Optionally, the first element is at least partially obscured when viewed from at least one angle, and the second element is at least partially obscured when viewed from the at least one angle. Similarly, the first element may be clearly visible when viewed from at least one angle, and the second element may be clearly visible when viewed from the at least one angle. In another embodiment, the first element is visible when viewed from at least one angle, the second element is visible when viewed from the at least one angle, and the first intensity is different than the second intensity when viewed from the at least one angle.

Optionally, the feature further comprises a third element, optionally comprising metallic nanoparticles, the third element being at least partially coplanar with the first element and the second element, and the third element causing incident light to be reflected in a third intensity that varies as the angle of incidence changes relative to the surface of the reflective feature. The variance of the third intensity optionally is different than the variance of the first intensity and the variance of the second intensity. In one aspect, the third element is at least partially coplanar with the first element and the second element, the third element forming an image. In another embodiment, the third element is disposed on top of at least one of the first element and/or the second element, and the third element causes incident light to be reflected in a third intensity that varies as the angle of incidence changes. The variance of the third intensity optionally is different than the variance of the first intensity and the variance of the second intensity.

Optionally, the first element comprises a first pattern, and the second element comprises a second pattern. The first pattern and/or the second pattern may be continuous or non-continuous. The first pattern may comprise a first series of a first shape. Similarly, the second pattern may comprise a second series of a second shape. For example, the first pattern optionally comprises a first series of first lines, and the second pattern optionally comprises a second series of second lines. The first lines optionally have a first average width, optionally less than about 500 μm, and are separated from one another by a series of first gaps having a first average gap width that is less than twice the first average width. Similarly, the second lines optionally have a second average width, optionally less than about 500 μm, and are separated from one another by a series of second gaps having a second average gap width that is less than twice the second average width. The first lines may comprise first parallel lines, and the second lines may comprise second parallel lines. The first parallel lines may be laterally separated by a plurality of first lateral gaps, and the second parallel lines may be laterally separated by a plurality of second lateral gaps. The average width of the first lateral gaps may be the same or different than the average width of the second lateral gaps. Similarly, the average width of the first parallel lines may be the same or different than the average width of the second parallel lines. Optionally, the orientation of the first parallel lines with respect to the second parallel lines is oblique, at an angle of from about 1 degree to about 179 degrees, at an angle of from about 45 degrees to about 135 degrees, or at an angle of about 90 degrees. Optionally, at least one of the first element and/or the second element at least partially overlaps a third element comprising an image on a substrate surface. An image optionally is disposed on at least a portion of at least one of the first element and/or the second element. In this aspect, the image may be clearly visible when viewed at a first angle and be at least partially obscured when viewed at a second angle.

At least one of the first element or the second element optionally is translucent, semitransparent or opaque. In one embodiment, the first element optionally comprises an alphanumeric character. In this aspect, the second element optionally comprises a compliment shape to the first element.

In another embodiment, the invention is to a process for forming a reflective feature, e.g., the features of the present invention, the process comprising direct write printing, e.g., piezo-electric, thermal, drop-on-demand or continuous ink jet printing, an ink comprising metallic nanoparticles onto a substrate surface in a design, the design comprising a first element at least partially coplanar with a second element. Optionally, the process further comprising the step of: direct write printing the ink onto the substrate surface in a second design comprising a third element, wherein the third element is disposed on top of the first element and the second element. The invention is also to reflective features formed by the inventive process.

BRIEF DESCRIPTION OF THE DRAWINGS

The present invention will be better understood in view of the appended non-limiting figures, wherein:

FIG. 3 illustrates a non-limiting example of a reflective feature of the present invention comprising a first element with an overall form of an image of a fingerprint with a continuous pattern and a second element with an overall form that is a complement to the overall form of the first element with a pattern comprising a series of parallel lines; and FIG. 4 illustrates the angle of incidence between a light source reflected off of a reflective feature surface to three different viewing angles.

DETAILED DESCRIPTION OF THE INVENTION

Introduction

Figure 1A:
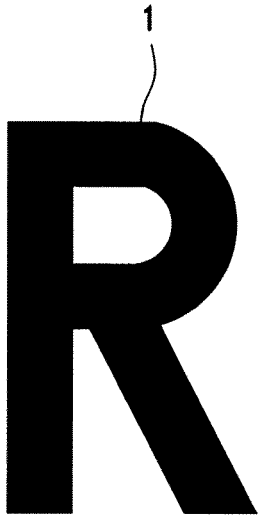
FIGS. 1A-D illustrate non-limiting examples of patterns within an element.

Reflective features, e.g., reflective security feature or reflective decorative features, in various applications such as branded products, for example, perfumes, drugs, tobacco, alcohol products and the like, and security documents, for example, passports, bonds, tickets, tax stamps, banknotes, and the like, have become a very important industry. Counterfeiters are becoming more sophisticated, and technology developments such as advanced color copiers are making it easier for these individuals to deprive businesses and consumers of billions of dollars per year.

This invention provides features and processes that may be employed to combat sophisticated counterfeit technology as well as for decorative purposes. In one embodiment, the present invention relates to a reflective feature, e.g., security feature or decorative feature, comprising a first element that is at least partially coplanar with a second element. As used herein, the term "security feature" means a feature that is placed on or otherwise incorporated into an article (e.g., a tag or label, a document such as a passport, check, bond, banknote, currency, ticket, etc.), directly or indirectly, for the purpose of authenticating the article. As used herein, the term "decorative feature" means a feature that is not provided primarily for an authentication purpose, but rather primarily for a graphical or decorative purpose. The coplanarity of the elements allows for the efficient printing, depositing, or otherwise placing of an ink, preferably an ink comprising metallic nanoparticles, on top of a substrate surface, preferably in a single printing pass, although multiple passes may alternatively be employed.

Preferably, one or more of the reflective feature, and/or the first element and/or second element are highly reflective, meaning they exhibit at least some degree of non-diffuse or non-Lambertian reflectivity. That is, one or more of the reflective feature, and/or the first element and/or second element preferably exhibit some degree of specular reflectivity. It is contemplated, however, that the reflective feature and elements forming the feature may exhibit some degree of diffuse reflectivity in addition to specular reflectivity. As a percentage of incident light, either or both the first element and/or the second element, and/or the reflective feature itself, optionally reflects greater that 60%, greater than 80% or greater than 90% of the incident light as specular reflectance.

In a preferred aspect of the present invention, the first element causes incident light to be reflected with a first intensity that varies as the angle of incidence changes relative to a surface of the reflective feature. The term "angle of incidence," as used herein, refers to the angle created by the light source shining on a surface of the reflective feature, relative to the substrate surface. This may allow the first element to be visible when viewed from a first angle and to be at least partially obscured when viewed from a second angle. Further, the second element optionally causes incident light to be reflected with a second intensity that varies as the angle of incidence changes relative to the surface of the reflective feature. In a preferred embodiment, this effect allows the second element to be at least partially obscured when viewed from the first angle and to be visible when viewed from the second angle. In another aspect of this invention, the variation of the first intensity as the angle of incidence changes differs from the variation of the second intensity as the angle of incidence changes. This aspect of the invention therefore allows variation among which elements of a reflective feature are viewable, are at least partially obscured, or are distinguishable, depending on the angle of incidence. This embodiment of the invention provides a unique variable appearance that is difficult to reproduce and is therefore of great value in the security industry. The features also have particular value in the field of graphics, for example as a reflective decorative feature.

Another aspect of the present invention relates to a process for forming reflective features, e.g., reflective security features or reflective decorative features, the process comprising printing, e.g., direct write printing, an ink comprising metallic nanoparticles onto a substrate surface in a design, the design comprising a first element at least partially coplanar with a second element. This aspect of the invention makes it feasible and efficient to create reflective features containing coplanar elements comprising metallic nanoparticles.

Reflective Features with Coplanar Elements

As indicated above, in a first embodiment, the present invention is directed toward a reflective feature comprising a first element that is at least partially coplanar with a second element. The present invention optionally comprises a third element that is at least partially coplanar with the first element and the second element. In other embodiments (discussed below), the third element resides in a different plane, e.g., different laterally extending plane, than the first and/or second element. The reflective feature may further comprise additional elements (e.g., fourth, fifth or sixth elements), which may or may not be at least partially coplanar with one or more of the first, second and/or optional third elements. The first element, second element and optional third element preferably are disposed on a substrate surface. As used herein, a "element" is a portion of a reflective feature. The term "coplanar" means extending in the same laterally extending plane, wherein the longitudinal direction is a direction substantially perpendicular to the substrate surface and the lateral direction is a direction substantially parallel to the substrate surface. That is, to be at least partially coplanar, the first, second and optional third elements must exhibit some degree of height range overlap, as discussed below with reference to FIGS. 2A-D.

An element, e.g., the first element, the second element or the optional third element, may extend longitudinally above a substrate surface and/or may extend longitudinally below the substrate surface. Factors affecting an element's height range longitudinally above and/or below a substrate surface include, but are not limited to, ink surface tension, substrate surface porosity, and the presence of any substrate surface irregularities. In this embodiment of the present invention, the amount of longitudinally extending height range overlap between the first, second and optional third elements may vary from about greater than 0% to 100% overlap, e.g., greater than 1% overlap, greater than 10% overlap, greater than 20% overlap, greater than 30% overlap, greater than 40% overlap, greater than 50% overlap, greater than 60% overlap, greater than 70% overlap, greater than 80% overlap, greater than 90% overlap, or about 100% overlap, based on the total longitudinal height of a given element.

Figure 2A:
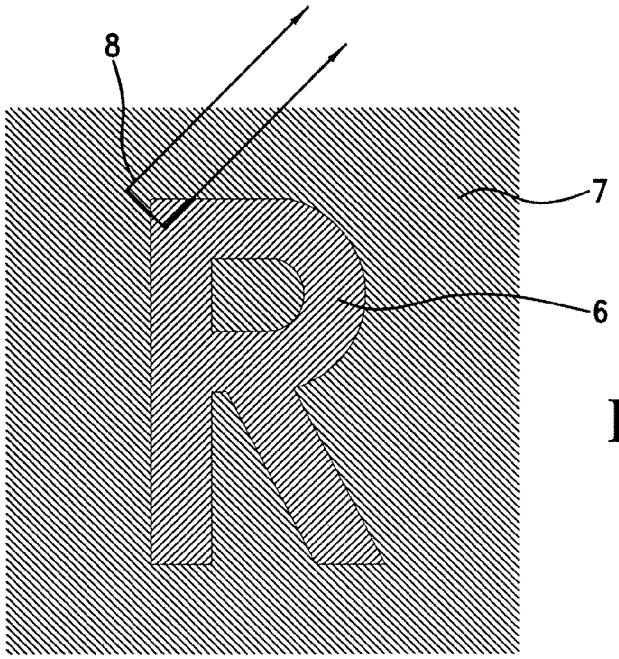
FIGS. 2A-E illustrate different embodiments of the coplanar elements of the present invention.

FIG. 2A illustrates one embodiment of a reflective feature comprising a first element that is at least partially coplanar with a second element. In FIG. 2A, the first element has an overall form of the alphanumeric character "R" and a second element with an overall form that complements the overall form of the first element. As used herein, the "overall form" of an element means the shape or outline of an element. In this example, the first element comprises a first pattern comprising a first series of first parallel lines 6, which creates the overall form of the first element, and the second element comprises a pattern comprising a second series of second parallel lines 7, which creates the overall form of the second element. In this embodiment, the first parallel lines 6 are oriented at an angle of about 90 degrees with respect to the second parallel lines 7, although other angles are possible in accordance with the present invention.

Figure 2B:
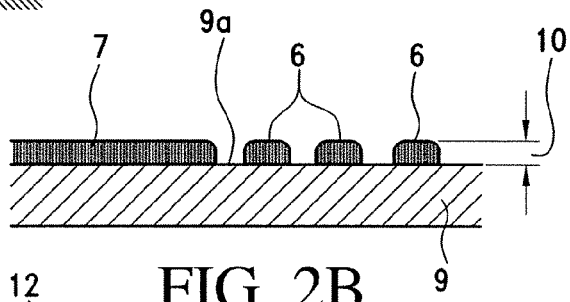

FIG. 2B is a cross section taken along line 8 of FIG. 2A of one embodiment of the reflective feature of FIG. 2A. The cross section specifically shows one section of the border between the first element and the second element on substrate surface 9*a* of substrate 9. In this example, the reflective feature of the present invention comprises elements formed from high surface tension ink. In general, an element formed from high surface tension ink tends to occupy a greater longitudinally extending height range above the substrate surface than does a reflective feature formed from low surface tension ink. Also in this example, the reflective feature is disposed on top of a generally planar substrate surface 9*a* having no visible surface irregularities. In general, an element disposed on a substrate surface having fewer surface irregularities tends to occupy a greater longitudinally extending height range above the substrate surface than does an element disposed on a substrate surface having a high degree of surface irregularities. Also in this example, the substrate surface 9*a* exhibits low porosity. Generally, an element disposed on a substrate having a substrate surface of low porosity tends to occupy a greater longitudinally extending height range above the substrate surface than does an element disposed on a substrate having a highly porous substrate surface due to the infiltration or wicking of the ink into the pores of highly porous substrate surfaces. As shown by height range overlap 10, the lines 6 of the first element and the lines 7 of the second element are at least partially coplanar with respect to one another. Thus, the first element is at least partially coplanar with the second element.

Figure 2C:
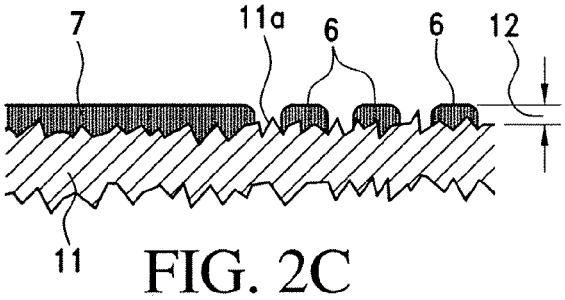

FIG. 2C is a cross section taken along line 8 of FIG. 2A of another embodiment of the reflective feature of FIG. 2A. The cross section specifically shows one section of the border between the first element and the second element. In this example, the reflective feature is disposed on top of a substrate 11 having substrate surface 11*a* of high irregularity. As shown by height range overlap 12, the lines 6 of the first element and the lines 7 of the second element are at least partially coplanar with respect to one another. Thus, in this embodiment, the first element is at least partially coplanar with the second element.

Figure 2D:
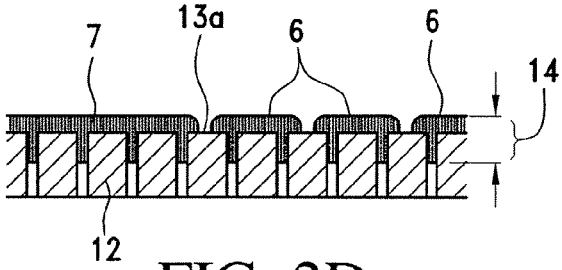

FIG. 2D is a cross section taken along line 8 of FIG. 2A of another embodiment of the reflective feature of FIG. 2A. The cross section specifically shows one section of the border between the first element and the second element. In this example, the reflective feature is disposed on top of substrate 13 having substrate surface 13*a* of high porosity. As shown by height range overlap 14, the lines 6 of the first element and the lines 7 of the second element are at least partially coplanar with respect to one another. Thus, in this embodiment, the first element is at least partially coplanar with the second element.

Figure 2E:
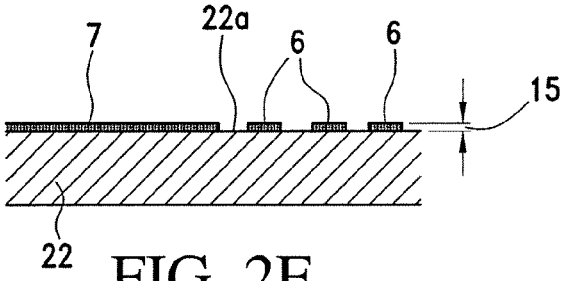

FIG. 2E is a cross section taken along line 8 of FIG. 2A of another embodiment of the reflective feature of FIG. 2A. The cross section specifically shows one section of the border between the first element and the second element. In this example, the reflective feature is disposed on top of substrate 22 having a non-porous, non-irregular substrate surface 22*a*. In this example, the reflective feature of the present invention comprises elements formed from low surface tension ink. As discussed above with reference to FIG. 2B, an element formed from a low surface tension ink tends to occupy a lesser longitudinally extending height range above the substrate surface than does a reflective feature formed from a high surface tension ink. As shown by height range overlap 15, the lines 6 of the first element and the lines 7 of the second element are at least partially coplanar with respect to one another. Thus, in this embodiment, the first element is at least partially coplanar with the second element.

As discussed above, the reflective features of the present invention comprise coplanar elements. In one embodiment, the invention is to a reflective feature comprising a first element at least partially coplanar with a second element. Optionally, the reflective feature further comprises a third element, optionally comprising metallic nanoparticles, at least partially coplanar with the first element and/or the second element. Alternatively, the third element is not coplanar with the first element or the second element.

The overall forms of the at least partially coplanar elements (e.g., first, second or optional third element) may be complementary to one another such that the overall form of each respective at least partially coplanar element does not overlap any of the other at least partially coplanar elements. For example, the first element preferably does not overlap the second element. Alternatively, the one or more of the elements may partially overlap one or more of the other elements. For example, the first element may overlap a portion of the second element, or vice versa, so long as at least a portion of the first element is coplanar with at least a portion of the second element. Preferably, the overall forms of the elements of the reflective feature (e.g., the first, second or optional third elements) are adjacent to one another such that substantially all areas of the reflective feature are free of appreciable gaps between adjacent elements.

FIG. 2A, discussed above, illustrates one example of a complementary arrangement of overall forms of at least partially coplanar elements. In this example, the reflective feature comprises a first element (formed from lines 6) having an overall form of the alphanumeric character "R" and a second element (formed from lines 7) having an overall form that complements the overall form of the first element. In effect, the overall form of the second element forms a background for the first element, outlining the alphanumeric character "R" created by the first element.

The elements incorporated in the reflective features of the present invention may take on a variety of different overall forms. The overall form may be continuous, e.g., a single alphanumeric character or geometric shape. In this embodiment, by "continuous" it is meant a single, discreet, connected object or part of an object, e.g., an object formed from ink, substantially free of gaps. Alternatively, the overall form may be non-continuous, e.g., a serial number comprising more than one alphanumeric character or a plurality of microimages, e.g., microprint. By way of non-limiting examples, the overall form of an element (e.g., a first, second or third element) according to the various embodiments of the present invention may comprise one or more alphanumeric characters, a fingerprint, a personal image, a signature, a logos, a barcodes, a trademark, a pattern, e.g., a guilloche pattern or rosette pattern, or other object. In a preferred embodiment, at least one of the first element or the second element comprises variable information, microprint (2 pt font size or smaller, height less than about 400 μm), and/or alphanumeric characters. For security applications, any recognizable overall form may be chosen for any given element, so that the reflective feature may function to identify an item and/or verify its authenticity. By way of a non-limiting example, the overall form of any of the elements (e.g., first, second or third elements) may relate to or represent a brand or trade name of a product to which the reflective feature is attached or otherwise associated. As another non-limiting example, the overall form of one or more of the elements of the reflective features of the present invention may comprise all or part of a set of variable information, e.g., a serial number.

FIG. 3 illustrates a reflective feature 23 comprising a first element 16 with an overall form of an image of a fingerprint and a second element 17 with an overall form that is the complement to the overall form of the first element. In essence, the overall form of the second element forms an outline background, or inverse, to the overall form of the first element. In this embodiment, the second element comprises a pattern comprising a series of parallel lines, which create the overall form of the second element.

As indicated above, one important aspect of the reflective features of the present invention is that one or more of the elements cause incident light to be reflected in an intensity that varies as the angle of incidence changes relative to a surface of the reflective feature and/or as the angle at which an observer looks at the feature (the "viewing angle") changes and/or as the position of the reflective feature changes. Thus, in one embodiment of the present invention, the reflective feature comprises a first element at least partially coplanar with a second element, wherein the first element causes incident light to be reflected with a first intensity that varies as the angle of incidence changes relative to a surface of the reflective feature and/or as the angle of viewing changes and/or as the position of the reflective feature changes. This intensity variance allows such elements to be visible when viewed from a first angle and to be at least partially obscured, preferably totally obscured, when viewed from a second angle. Another advantage of this aspect of the invention is that, when viewed from various angles (or at various angles of incidence or various positions of the reflective feature), different elements within a reflective feature will cause incident light to be reflected in different intensities. This aspect of the invention allows variation among which elements of a reflective feature are viewable, depending on the angle of incidence, the viewing angle and the position of the feature. This unique variable appearance feature of the reflective features of the present invention is difficult to reproduce and is therefore a valuable security aspect of the present invention. In this embodiment, whether the first element is visible, partially obscured or totally obscured depends, among other factors, upon the angle of incidence, the intensity of the light source, the viewing angle, and the particular patterns chosen for the first, second and optional third elements. Optionally, the second element also causes incident light to be reflected with an intensity, e.g., a second intensity (different from the first intensity), that varies as the angle of incidence changes relative to a surface of the reflective feature, and/or as the viewing angle changes and/or as the position of the reflective feature changes. In this embodiment, whether the second element is visible, partially obscured or totally obscured depends, among other factors, upon the angle of incidence, the intensity of the light source, the viewing angle, the position of the feature, and the particular patterns chosen for the first, second and optional third elements.

In a preferred embodiment, the variance of the first intensity of incident light reflected by the first element as the angle of incidence changes is different than the optional variance of the second intensity of incident light reflected by the second element as the angle of incidence changes. In this embodiment, the reflective feature exhibits a flashing or shimmering effect as the angle of incident light changes and/or as the viewing angle changes. In this embodiment, whether an element (e.g., first, second or optional third element) of the reflective feature is viewable depends on the angle of incidence, the viewing angle and the position of the feature as well as the particular patterns chosen for the first, second and optional third elements. This aspect provides a highly-secure difficult-to-reproduce feature in which multiple elements flash "on and off" as the angle of incidence changes and/or as the viewing angle changes and/or as the position of the reflective feature changes.

In a preferred embodiment, either or both the first element and/or the second element comprise metallic nanoparticles. Elements comprising metallic nanoparticles have been found to exhibit enhanced reflectivity over conventional reflective features. In addition, elements comprising metallic nanoparticles exhibit greater contrast of reflective intensity as the angle of incidence changes and/or as the viewing angle changes and/or as the position of the feature changes over conventional reflective features. In a particularly preferred embodiment, the first element and/or the second element comprise metallic nanoparticles, such that in this embodiment the first element and/or the second element exhibit enhanced reflectivity and greater variability of reflective intensity as the angle of incidence changes and/or as the viewing angle changes. The use of metallic nanoparticles to form the reflective features also desirably allows the features to be formed through a direct write printing process, e.g., an ink jet or digital printing process, as described in greater detail below.

In one embodiment, the reflective feature additionally comprises a third element at least partially coplanar with the first element and the second element, wherein the third element causes incident light to be reflected in a third intensity that varies as the angle of incidence changes relative to the surface of the reflective feature and/or as the viewing angle changes and/or as the position of the reflective feature changes. Optionally, the third element comprises metallic nanoparticles. In a preferred embodiment, the variance of the third intensity is different than the variance of the first intensity and/or the variance of the second intensity.

The variable effect is more pronounced when the reflective feature is viewed under a point light source, as opposed to when viewed under a diffuse light source. The light source, e.g., point light source, preferably produces white light as opposed to colored light, although the invention is not limited to any particular type of light source. Other types of light or light sources may be used, e.g., daylight, black light, or fluorescent light. Non-visible light sources may be used as well, e.g., infrared or ultraviolet light sources. Additionally, the present invention is not limited by the intensity of the light source, although the use of more intense light sources is generally preferred over the use of less intense light sources.

In a preferred embodiment, the variable reflectivity of one or more of the first element, the second element and/or the optional third element causes one or more of the first element, the second element and/or the optional third element to become at least partially obscured when viewed from certain angles. For example, in a preferred embodiment, the reflective feature of the present invention comprises a first element that is visible when viewed from a first angle and a second element that is at least partially obscured when viewed from the first angle. Preferably, the first element is at least partially obscured when viewed from a second angle and the second element is visible when viewed from the second angle. Preferably, when viewed from at least one angle, e.g., a third angle, both the first element and the second element are clearly visible, but are readily distinguishable from one another, i.e., are distinguishable with the naked eye or with the assistance of low power magnification, e.g., a magnifying glass or loop. That is, when viewed from at least one angle, e.g., the third angle, both the first element and the second element are visible and distinguishable, and the first element reflects incident light in a first intensity that differs from a second intensity at which the second element reflects incident light, such that the first element is visibly distinguishable from the second element.

FIG. 4 illustrates a reflective feature 25 comprising a first element (having the overall form comprising the alphanumeric character "R") 30 and a second element (having an overall form comprising the inverse of the first element) 31. FIG. 4 also illustrates the angle of incidence 18 between a light source 19 and reflective feature 25 on substrate surface 20. FIG. 4 also illustrates three viewing angles: a first viewing angle 24 between a first point of viewing 21 and the reflective feature 25 on substrate surface 20, a second viewing angle 28 between a second point of viewing 26 and the reflective feature 25 on substrate surface 20, and a third viewing angle 27 between a third point of viewing 27 and the reflective feature 25 on substrate surface 20. In this example, the angle of incidence 18 and the first viewing angle 24 are each about 30 degrees.

As indicated above, FIG. 4 shows three viewing angles, 24, 28 and 29. At the third viewing angle 27, the first element 30 and the second element 31 are both visible and clearly distinguishable from one another, as shown by inset image 32 (showing both first element 30 and second element 31). At the second viewing angle 28, the first element 30 is visible, but the second element is not visible, e.g., is obscured, as shown by inset image 33. At the first viewing angle 24, the second element 31 is visible, but the first element is not visible, e.g., is obscured, as shown by inset image 34. The same effect may be observed while maintaining a constant viewing angle relative to the surface of the reflective feature by moving: (1) the light source 19 (in the x, y and/or z directions); and/or (2) the reflective feature 25

(in the x, y and/or z directions). It should be understood that the viewing angles shown in FIG. 4 are illustrative only, and the angle at which a given element may become visible or obscured will vary widely depending primarily on the designs used to form the first and second elements.

Many factors will influence the degree of obscuring observed as well as the angles at which the various elements are visible or obscured such as the composition of the elements, the orientation of the design(s) used to form the elements as well as the position of the feature, the viewing angle, the angle of incidence and the position, type and intensity of the light source. For example, if lines, e.g., parallel or curved lines, are used to form the first and/or second elements, then the thickness of the lines and the width of the gaps between adjacent lines will play an important role in determining whether an element is visible or obscured. The orientation of lines (or portion(s) of the lines) relative to the incoming incident light also plays a role in whether an element is visible or obscured. In general, lines that are disposed on the substrate in the same plane (or closer to the same plane) as the incident light reflect light at a lesser intensity than lines that are disposed in a direction perpendicular (or closer to perpendicular) to the incident light. Thus, light reflected off of lines that are oriented closer to perpendicular to incident light tends to a be reflected at a greater intensity than light reflected off of lines that are closer to parallel to incident light. As a result, the lines that are oriented closer to parallel to the incident light are more likely to become obscured by the light that is reflected off of the lines that are oriented closer to perpendicular to the incident light than vice versa.

In one embodiment, either or both the first and/or second elements are disposed over, e.g., on top of, an image or a portion of an image. In this embodiment, the present invention is to a reflective feature comprising a first element at least partially coplanar with a second element, wherein at least one of the first element and/or the second element at least partially overlaps a third element comprising an image on a substrate surface. The underlying image may comprise a color image, a black and white image, a fluorescent image, a phosphorescent image or a reflective image. In one embodiment, the image comprises metallic nanoparticles.

In the embodiment where the first and/or second elements are disposed over an underlying image, the image preferably is at least partially visible through the first and/or second elements when viewed at one angle. The image may become obscured, however, when viewed from another angle, relative to the surface of the reflective feature. This aspect of the invention provides even further security in that the image underneath the first and/or second elements may exhibit variable reflectivity in addition to the first and second elements themselves. The effect of obscuring an underlying image is further described in co-pending U.S. patent application Ser. No. 11/331,233, filed Jan. 13, 2006, entitled "Security Features, Their Use and Processes for Making Them,", published as US 2007/0190298 A1, the entirety of which is incorporated herein by reference.

In another embodiment, the reflective feature further comprises a third element, e.g., image, comprising metallic nanoparticles, disposed over, e.g., on top of, either or both of the first element and/or the second element. In one embodiment, the third element comprises an image that is disposed on top of at least one of the first element and/or the second element. Optionally, the image is clearly visible when viewed from one angle (a first angle) and the image is at least partially obscured when viewed from another angle (a second angle). The overlying third element may cause incident light to be reflected in a third intensity that varies as the angle of incidence changes. Optionally, the variance of the third intensity is different than the variance of the first intensity and/or the variance of the second intensity.

The reflective feature of the present invention may comprise any combination of the above-described elements. For example, in one embodiment, the first and second elements are disposed at least in part on top of an underlying third element, and an overlying element (a fourth element) is disposed on top of at least one of the first element and/or the second element. Optionally, the underlying third element and/or the overlying (fourth) element is clearly visible when viewed from one angle (a first angle) and is at least partially obscured when viewed from another angle (a second angle). In this embodiment, the underlying third element and/or the overlying (fourth) element may cause incident light to be reflected in a third and fourth intensities, respectively, either or both of which may vary as the angle of incidence changes, and/or as the viewing angle changes and/or as the position of the reflective feature changes. Optionally, the variance of the third and/or fourth intensities is different than the variance of the first intensity and/or the variance of the second intensity.

Any of the above-described elements may comprise any of a variety of different patterns within its overall form. Although not limited to these embodiments, an element may comprise a pattern that is continuous, a pattern that comprises a series of a shape, a pattern that comprises a series of lines (e.g., wavy lines, sinusoidal lines, or zigzag lines), or a pattern that comprises a series of parallel lines.

FIGS. 1A-D illustrate different embodiments of a single element that takes on the overall form of the alphanumeric character "R". In one embodiment, the pattern used to form the overall form may be continuous, as defined above. FIG. 1A illustrates an element 1 having the overall form of the alphanumeric character "R". The overall form of element 1 is formed by a continuous pattern. The pattern employed to form element 1 is deemed continuous because it is formed of a single discreet, connected object, substantially free of gaps.

Figure 1B:
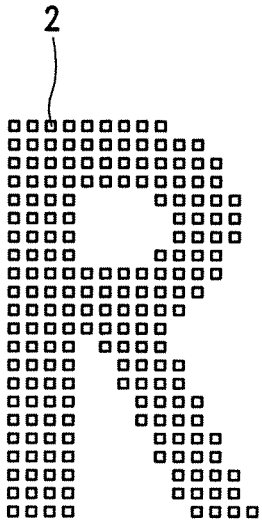

In another embodiment, one or more of the elements are formed of a non-continuous pattern or patterns. The pattern (s) may, for example, comprise a series of shapes, e.g., the same shape or different shapes. The series is preferably uniform, such that the dimensions of each complete member of the series, as well as the gaps between adjacent shapes in the series, are substantially similar. Each shape may be, but is not limited to being, any particular geometric shape, e.g., rectangle, triangle, square or circle. FIG. 1B illustrates an element that takes on the overall form of the alphanumeric character "R" comprising a series of square shapes 2.

In another embodiment, a pattern used to form the overall form of an element, e.g., the first, second and/or optional third element, may comprise a plurality of lines, preferably a series of lines. The lines preferably have an average line width of less than about 500 μm, e.g., less than about 400 μm, less than about 300 μm, less than about 200 μm, less than about 100 μm, less than about 75 μm or less than about 50 μm. In one embodiment, the lines are separated from each other by a series of gaps, the average gap width preferably being less than twice, e.g., less than 1.5×, less than 1× or less than 0.5×, the average line width. The orientation of the lines used to form the overall form of an element may vary widely. Some preferred orientations for lines include straight, wavy, zigzagged, sinusoidal and parallel lines. This list of line types is by no means exhaustive, as many other orientations of the lines may be employed. Preferably, the lines are formed from a plurality of printed "dots", e.g., microscopic dots, which may or may not be distinguishable from one another (e.g., on a microscopic scale) on the substrate surface.

Figure 1C:
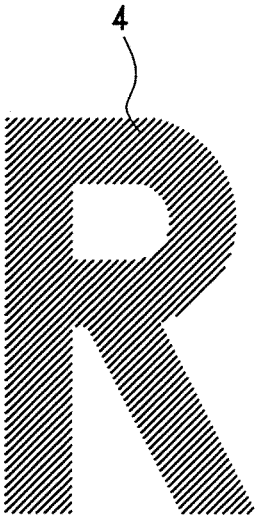
Figure 1D:
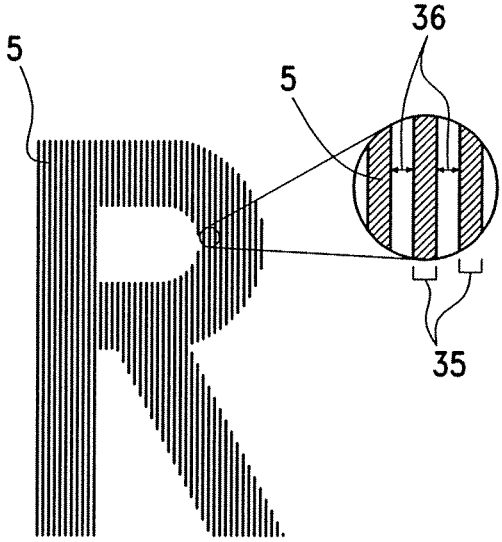

In a preferred embodiment, a pattern used to form an overall form of an element, e.g., the first, second and/or optional third element, comprises a series of parallel lines. The parallel lines preferably have an average line width of less than about 500 μm, e.g. less than about 400 μm, less than about 300 μm, less than about 200 μm, less than about 100 μm, less than about 75 μm or less than about 50 μm. In one embodiment, the parallel lines are laterally separated from each other by a series of laterally extending gaps, the average gap width preferably being less than twice, e.g., less than 1.5×, less than 1× or less than 0.5×, the average line width. FIG. 1C illustrates an element that takes on the overall form of the alphanumeric character "R" comprising a series of parallel lines 4. FIG. 1D illustrates an element that takes on the overall form of the alphanumeric character "R" comprising a series of a parallel lines 5. The inset in FIG. 1D also illustrates that parallel lines 5 have line widths 35, and that the lines 5 are separated by a series of lateral gaps 36. Comparing FIG. 1C to FIG. 1D illustrates that the series of parallel lines are not limited to a specific orientation with respect to the overall form the element.

In various embodiments, the reflective feature of the present invention comprises a first element that is at least partially coplanar with a second element, wherein the first element comprises a first pattern and the second element comprises a second pattern. In one embodiment, the first pattern is continuous and/or the second pattern is continuous, as defined above. In another embodiment, the first pattern is non-continuous, and/or the second pattern is non-continuous. In another embodiment, the first pattern is non-continuous and the second pattern is continuous. In yet another embodiment, the first pattern is continuous and the second pattern is non-continuous. In another embodiment, the first pattern comprises a first series of a first shape, and, optionally, the second pattern comprises a second series of a second shape. In one embodiment, for example, the first pattern comprises a first series of first lines, and the second pattern comprises a second series of second lines. Either or both the first lines and/or the second lines may be straight, zig-zagged, wavy, curved, sinusoidal, or parallel. Optionally, the first lines have a first average width and are separated from one another by a series of first gaps having a first average gap width that is less than twice, e.g., less than 1.5×, less than 1× or less than 0.5×, the first average width. Optionally, the first average width is less than about 500 μm, e.g., less than about 400 μm, less than about 300 μm, less than about 200 μm, or less than about 100 μm. Optionally, the second lines have a second average width and are separated from one another by a series of second gaps having a second average gap width that is less than twice, e.g., less than 1.5×, less than 1× or less than 0.5×, the second average width. Optionally, the second average width is less than about 500 μm, e.g., less than about 400 μm, less than about 300 μm, less than about 200 μm, less than about 100 μm, less than about 75 μm, or less than about 50 μm.

In a preferred embodiment, the first lines comprise parallel lines and the second lines comprise parallel lines. Optionally, the first parallel lines are laterally separated by a plurality of first lateral gaps and the second parallel lines are separated by a plurality of second lateral gaps. Optionally, the average width of the first parallel lines is different than the average width of the second parallel lines. Optionally, the average width of the first lateral gaps is different than the average width of the second lateral gaps. In various embodiments, the orientation of the first parallel lines with respect to the second parallel lines is oblique, meaning oriented at an angle other than 90 degrees. More preferably, the orientation of the first parallel lines with respect to the second parallel lines is at an angle of from about 1 degree to about 179 degrees. More preferably, the orientation of the first parallel lines with respect to the second parallel lines is from an angle of from about 45 degrees to about 135 degrees. Most preferably, the orientation of the first parallel lines with respect to the second parallel lines is at an angle of about 90 degrees.

In one embodiment of the present invention, at least one of the first element or the second element is semitransparent. As used herein, the term "semitransparent" means capable of allowing at least some light to pass therethrough, e.g., through openings and/or through a translucent layer, while optionally absorbing a portion of the light. A semitransparent layer may also exhibit a photo-obscuring effect with respect to an underlying image, described above. Semitransparent elements may be formed by a printing process, e.g., a direct write printing process, preferably a digital printing process or an ink jet printing process.

In one embodiment of the present invention, at least one of the first element or the second element is translucent. As used herein, the term "translucent" means capable of allowing light to pass therethrough, but not exclusively through spaces or gaps (although some spaces and gaps may or may not be present in a translucent layer). In this aspect, the translucent element preferably is particularly thin, e.g., on the order of less than about 5 μm, less than about 1 μm, less than about 500 nm or less than about 100 nm, in order to allow light to pass therethrough. Features comprising such thin layers may be formed, for example, from inks having very low nanoparticle loadings. The translucent element may present a photo-obscuring effect. That is, the translucent element may be disposed on a substrate, the substrate surface of which comprises an image. The image may be viewable through the translucent element at a first angle relative to the substrate surface, but obscured at a second angle relative to the substrate surface as incident light is reflected off the translucent element toward the observer. Translucent elements may be formed by a printing process, e.g., a direct write printing process, preferably a digital printing process or an ink jet printing process.

In one embodiment of the present invention, at least one of the first element and/or the second element is opaque. As used herein, the term "opaque" means impervious to light, so that an underlying image cannot be seen through the element unless gaps are present in the opaque element. Opaque elements may be formed by a printing process, e.g., a direct write printing process, preferably a digital printing process or an ink jet printing process.

As indicated above, a reflective feature of the present invention preferably is disposed on a substrate surface of a substrate. The substrate preferably has a substrate surface that is flat or substantially planar. The substrate may or may not be porous. In one embodiment, the substrate is sufficiently porous such that the vehicle or vehicles in the ink or inks wet the paper, but the nanoparticles contained in the ink(s) remain substantially (e.g., greater than 50 wt. %, greater than 75 wt. % or greater than 90 wt. %) on the substrate surface. Possible substrates for use with the reflective features of the present invention include substrates having a low softening or melting point such as, e.g., various polymers. In a preferred embodiment of the invention, the substrate surface onto which the elements or features can be printed, deposited, or otherwise placed has a softening and/or decomposition temperature of not higher than about 300° C., e.g., not higher than about 250° C., not higher than about 225° C., not higher than about 200° C., not higher than about 185° C., not higher than about 150° C., or not higher than about 125° C.

Non-limiting examples of substrates having substrate surfaces of which are particularly advantageous for printing, depositing, or otherwise placing elements or features on include one or more of the following: a fluorinated polymer, polyimide, epoxy resin (including glass-filled epoxy resin), polycarbonate, polyester, polyethylene, polypropylene, bi-oriented polypropylene, mono-oriented polypropylene, polyvinyl chloride, ABS copolymer, wood, paper, metallic foil, glass, banknotes, linen, labels (e.g., self adhesive labels, etc.), synthetic paper, flexible fiberboard, non-woven polymeric fabric, cloth and other textiles. Other particularly advantageous substrates and substrate surfaces include cellulose-based materials such as wood, paper, cardboard, or rayon, and metallic foil and glass (e.g., thin glass). Although the elements and features of the present invention are particularly useful for temperature-sensitive materials, it is to be appreciated that other substrates such as, e.g., metallic and ceramic substrates, may be useful as well. Other possible substrates include open weave paper, calendered coated or non-coated paper, or thinly coated paper or non-continuously coated paper. In another embodiment, the substrate comprises a perforated or non-perforated Teslin™ film or coating, a strong hydrophobic synthetic film or coating manufactured by PPG Industries, Inc.

Possible uses for the reflective features of the present invention may vary widely. Generally, the reflective features of the invention may be employed in any product that is subject to counterfeiting, imitation or copying. Thus, in one embodiment, the invention is to a banknote comprising the reflective feature of the present invention. In another embodiment, the invention is to a fiduciary document comprising the reflective feature of the invention. In another embodiment, the invention is to a certificate of authenticity comprising the reflective feature of the invention. In another embodiment, the invention is to a brand authentication tag comprising the reflective feature of the present invention. In another embodiment, the invention is to an article of manufacture comprising a brand authentication tag comprising the reflective feature of the present invention. In another embodiment, the invention is to a tax stamp comprising the reflective feature of the present invention. In another embodiment, the invention is to an alcohol bottle comprising a tax stamp comprising the reflective feature of the present invention. In another embodiment, the invention is to a tobacco product container comprising a tax stamp comprising the reflective feature of the present invention. The present invention is not limited to the foregoing examples, and a number of other substrates and/or substrate surfaces may comprise the reflective features of the present invention.

The reflective features of the present invention are not limited to security applications. The features may also be employed, for example, for brand protection, brand personalization (e.g., short run personal care/cosmetics), trademarks, or in graphics, decorative features, non-secure documents (e.g., business cards, greeting cards, paper products, etc.), advertisements, mass mailings, wall paper, ceramic tiles, to name but a few. Thus, in one embodiment, the reflective feature comprises a decorative feature, defined above. The present invention is not limited to the foregoing examples, and a number of other substrates and/or substrate surfaces may comprise the features of the present invention.

Processes for Forming Reflective Features

In another aspect, the invention relates to a process for forming a reflective feature. In one embodiment, the process comprises printing, e.g., direct write printing, an ink comprising metallic particles, preferably metallic nanoparticles, onto a substrate surface in a design, e.g., a security design or decorative design, the design comprising a first element and a second element at least partially coplanar with the first element. As used herein, the term "design" refers to the overall form of each element within the reflective feature, as well as to the arrangement of each coplanar element of the reflective feature with respect to each other coplanar element.

In a preferred embodiment, the first element and the second element are formed from the same ink, which comprises the metallic particles, preferably metallic nanoparticles. Alternatively, the first and second elements are formed from different inks, e.g., a first ink and a second ink, respectively. In this latter embodiment, the first ink may be deposited before, after or simultaneously with the second ink. Either or both the first ink and/or the second ink may comprise the metallic particles, e.g., the metallic nanoparticles. Additionally or alternatively, either or both the first ink and/or the second ink may comprise a colorant, e.g., a dye or pigment. The ink or inks preferably comprise a vehicle to impart desired flow characteristics to the ink or inks, as well as one or more additives. Various ink compositions that may be used to form the reflective features of the present invention are fully described in co-pending U.S. patent application Ser. No. 11/331,233, published as US 2007/0190298 A1, previously incorporated herein by reference.

The treating optionally comprises simply allowing the deposited ink or inks to dry. In this embodiment, the vehicle in the deposited ink is allowed to vaporize (with or without application of one or more of heat, pressure, IR radiation and/or UV radiation) into the atmosphere to form the feature, e.g., reflective security feature or reflective decorative feature. After drying, the nanoparticles yielded from the ink during drying have a relatively high degree of reflectivity, meaning the nanoparticle film or layer formed from the ink or inks possesses a high degree of optical smoothness (e.g., having a surface roughness less than about 250 nm). With subsequent optional additional treating steps, e.g., heating, rolling, pressing, UV curing, IR curing, etc., the reflectivity increases as the optical smoothness of the nanoparticle film or layer is increased relative to the reflectivity in the case of allowing the deposited ink to dry without an additional treating step. Surface roughness of the feature after curing by one or more of heating, rolling, pressing, UV curing, or IR curing, may be on the order of 50 nm or less. Thus, depending on how the deposited ink or inks are treated, the reflective feature (e.g., the first element, and/or second element and/or optional third element thereof) has a route mean square surface roughness that is less than about 250 nm, less than about 100 nm, less than about 50 nm, or less than about 30 nm. If more than one ink is used to form the reflective feature, and if two or more of the inks are deposited sequentially, the deposited inks may be cured in a single treating step (after deposition of the multiple inks) or in multiple treating steps, e.g., a first ink may be deposited and then cured, followed by deposition of a second ink and curing of the second ink.

Preferably, the process further comprises the step of direct write printing (e.g., ink jet printing or digitally printing) the ink (or, if multiple inks are used, one or more of the first ink, the second ink or optional third ink, described below) onto the substrate surface to form one or more of the first, second and/or optional third element. The direct write printing optionally is selected from the group consisting of piezoelectric ink jet printing, thermal ink jet printing and continuous ink jet printing. In one embodiment, the first element comprises a first pattern and the second element comprises a second pattern. Optionally, at least one of the first pattern and/or the second pattern is continuous, as defined above. Additionally or alternatively, at least one of the first pattern and/or the second pattern is non-continuous.

In another embodiment, the first element comprises a first pattern, the second element comprises a second pattern, and the first pattern further comprises a first series of a first shape. The series is preferably uniform, such that the dimensions of each complete member of the series are substantially similar. The shape may be, but is not limited to being, rectangular, triangular, square or circular. In another embodiment, the first element comprises a first pattern that comprises a first series of a first shape, and the second element comprises a second pattern that comprises a second series of a second shape.

In one embodiment, the first element comprises a first series of first lines comprising metallic particles, preferably metallic nanoparticles, and the second element comprises a second series of second lines comprising metallic particles, preferably metallic nanoparticles. In a preferred embodiment the first lines have a first average width and are separated from one another by a series of first gaps having a first average gap width that is less than twice, e.g., less than 1.5×, less than 1× or less than 0.5×, the first average width. This maximum gap width in this embodiment of the process for forming a reflective feature is preferable in that it enhances the ability to distinguish the overall form of the first element from the overall form of the second element. In another embodiment, the first lines have a first average width of less than about 500 μm, e.g., less than about 400 μm, less than about 300 μm, less than about 200 μm, less than about 100 μm, less than about 75 μm, or less than about 50 μm. In another embodiment, the second lines have a second average width and are separated from one another by a series of second gaps having a second average gap width that is less than twice, e.g., less than 1.5×, less than 1× or less than 0.5×, the second average width. In another embodiment, the second lines have a second average width of less than about 500 μm, e.g., less than about 400 μm, less than about 300 μm, less than about 200 μm, less than about 100 μm, less than about 75 μm, or less than about 50 μm. In a preferred embodiment, the first element comprises first lines that comprise first parallel lines and, optionally, the second element comprises second lines that comprise second parallel lines. In another embodiment, the first parallel lines are laterally separated by a plurality of first lateral gaps, and the second parallel lines are laterally separated by a plurality of second lateral gaps. In another embodiment, the orientation of the first parallel lines with respect to the second parallel lines is oblique. In another embodiment, the orientation of the first parallel lines with respect to the second parallel lines is at an angle of from about 1 degree to about 179 degrees, or more preferably from about 45 degrees to about 135 degrees. In a preferred embodiment, the orientation of the first parallel lines with respect to the second parallel lines is at an angle of about 90 degrees.

In another embodiment, the design further comprises a third element. The third element may be at least partially coplanar with or, alternatively, not coplanar with (e.g., disposed above or below), the first element and the second element. If the optional third element is coplanar with the first and second elements, the process may include the step of depositing an ink (e.g., a third ink) onto the substrate surface to form the coplanar third element. The ink used to form the optional third element may be the same ink that was used to form either or both the first element and/or the second element, or may be a different ink.

In another embodiment, the third element is not coplanar with the first element and/or the second element. For example, the third element optionally forms an image, which may be formed above or below the first and second elements, rather than in the same plane thereof. By way of non-limiting examples, the image may comprise a personal image, a fingerprint, a barcode, a logo, a trademark, a pattern, e.g., guilloche pattern or rosette pattern, or other object.

In this embodiment, the present process for forming a reflective feature optionally further comprises forming a third element comprising an image on at least a portion of at least one of the first element and/or the second element. In a preferred embodiment, the image that is formed on at least a portion of at least one of the first element and/or the second element is visible when viewed from a first angle and is at least partially obscured when viewed at a second angle.

If the reflective feature is to include a non-coplanar third element disposed on top of the first and/or second elements, an ink (e.g., a third ink) optionally is deposited (preferably printed, e.g., direct write printed, ink jet printed (piezoelectric, thermal or continuous ink jet printed), or digitally printed) onto the first element and/or the second element in a second design to form the third element, wherein the third element is disposed on top of the first element and the second element. In this context, the term "disposed on top of" is meant to distinguish the third element in this embodiment from other embodiments of the present invention in which the third element, being part of the first design, is at least partially coplanar with the first element and the second element. As the third element of this embodiment resides in a different plane than the first element and the second element, the overall form of third element may at least partially overlap and/or at least partially potentially obscure the first element and the second element. In this embodiment, it is generally desirable to have fully formed, e.g., cured, the first and second elements prior to deposition of the ink, e.g., third ink, used to form the third element so as to minimize bleeding between the first and second elements and the deposited ink used to form the third element. It is contemplated, however, that in some circumstances limiting bleeding between adjacent longitudinally parallel layers may be acceptable or desired.

In another embodiment, the third element comprises an underlying third element, meaning it is not coplanar with the first or second elements and is disposed underneath the first and/or second elements. In this embodiment, at least one of the first element or the second element at least partially overlaps a third element comprising an image on a substrate surface. This aspect of the invention is particularly useful because it is highly desirable to create a reflective feature that contains first and/or second elements that overlap an underlying image (third element) disposed on a substrate surface to create a difficult-to-reproduce photo-obscuring effect, described above. As a non-limiting example, a banknote may comprise a reflective feature comprising first and/or second elements that take the overall form of a serial number comprising alphanumeric characters, the first and/or second elements at least partially overlapping an third element comprising an image on a substrate surface. In another embodiment, the image on the substrate surface may comprise metallic nanoparticles.

If the reflective feature is to include a non-coplanar third element disposed underneath the first and/or second elements, an ink (e.g., a third ink) optionally is deposited (preferably printed, e.g., direct write printed, ink jet printed or digitally printed) onto the substrate surface in a second design to form the third element (e.g., underlying image). Preferably, the deposited third ink is cured, followed by deposition of one or more inks on top of the third element in order to form the first and second coplanar elements. In this manner, the third element is disposed underneath the first element and/or the second element. In this embodiment, it is generally desirable to have fully formed, e.g., cured, the third ink prior to deposition of the ink or inks (e.g., first and second inks) used to form the first and second elements so as to minimize bleeding between the first and second elements and the underlying third element. It is contemplated, however, that in some circumstances limiting bleeding between adjacent longitudinally parallel layers may be acceptable or desired.

In another embodiment, the invention is to a reflective feature formed by the process for forming a reflective feature described herein.

Metallic Particles

One or more of the elements, e.g., first element, second element or optional third element, as well as the inks (e.g., digital ink, direct write ink, or ink jet ink) optionally used to form the one or more elements preferably comprise metallic particles, more preferably metallic nanoparticles. As used herein, the term "metallic particles" means particles comprising a metal or metallic characteristic and having an average particle size of less than about 10 μm. Preferably, the metallic particles have an average particle size of less than about 7 μm, preferably less than about 5 μm, more preferably less than about 3 μm, and even more preferably less than about 2 μm. The term "metallic nanoparticles" means particles comprising a metal or metallic characteristic and having an average particle size of less than about 1 μm. One skilled in the art would appreciate that there are many techniques for determining the average particle size of a population of particles, scanning electron microscopy (SEM) being a particularly preferred technique. Other methods for determining the average particle size of micron-sized particles (e.g., from about 1 μm to about 10 μm) is by single particle light obscuration techniques (e.g., with an Accu-Sizer™ particle size analyzer). The average particle size of smaller particles (e.g., smaller than about 1 μm) is also determinable using quasi-elastic light scattering (QELS) techniques (e.g., using a Malvern™ ZetaSizer™). By "comprising a metal" it is meant all or a portion of the particles include, in whole or in part, a metal (e.g., an elemental metal (zero oxidation state) or a mixture or alloy of metals) or a metal-containing compound (e.g., a metal oxide or metal nitride). Thus, in a preferred embodiment, the metallic particles and/or metallic nanoparticles comprise a component selected from the group consisting of a metal, a metal alloy, and a metal-containing compound (e.g., a metal oxide). Additionally or alternatively, the metallic particles and/or metallic nanoparticles may comprise a component having a metallic characteristic. The term "metallic characteristic" means a reflective or lustrous optical property similar to a metal. For example, a component may exhibit a metallic characteristic by virtue of it having a small electronic band gap.

As indicated above, the metallic particles and/or metallic nanoparticles of the invention preferably have an average particle size of less than about 1 μm. In another embodiment, the metallic particles and/or metallic nanoparticles have an average particle size of less than about 500 nm, more preferably less than about 250 nm, even more preferably less than about 100 nm, and most preferably less than about 80 nm. The metallic particles and/or metallic nanoparticles optionally have an average particle size greater than about 20 nm, greater than about 25 nm, greater than about 30 nm, greater than about 40 nm, greater than about 50 nm, greater than about 100 nm, greater than about 250 nm or greater than about 500 nm. In terms of ranges, the metallic particles and/or metallic nanoparticles of the invention optionally have an average particle size in the range of from about 20 nm to about 5 μm, preferably from about 25 nm to about 3 μm, more preferably from about 30 nm to about 2 μm, yet more preferably from about 40 nm to about 1 μm, more preferably from about 50 nm to about 500 nm, more preferably from about 50 nm to about 100 nm, and most preferably from about 50 nm to about 80 nm. The metallic particles and/or metallic nanoparticles may have a unimodal or multi-modal (e.g., bimodal, trimodal, etc.) particle size distribution.

In one embodiment, the metallic particles and/or metallic nanoparticles are substantially free of particles having a particle size (meaning largest dimension, e.g., diameter of a spherical particle) greater than 5 μm, e.g., greater than 4 μm, greater than 3 μm, greater than 2 μm, greater than 1 μm, greater than 500 nm, greater than 250 nm, or greater than 100 nm. For purpose of this patent specification and appended claims, "substantially free" means comprising not more than about 50%, preferably not more than about 40%, more preferably not more than about 30%, more preferably not more than about 20%, more preferably not more than about 10%, more preferably not more than about 5%, more preferably not more than about 1%, more preferably not more than about 0.5%, and most preferably not more than about 0.25%, by weight.

Non-limiting examples of metals for use in the metallic particles and/or metallic nanoparticles and reflective features of the present invention include transition metals as well as main group metals such as, for example, silver, gold, copper, nickel, cobalt, palladium, platinum, indium, tin, zinc, titanium, chromium, tantalum, tungsten, iron, rhodium, iridium, ruthenium, osmium, lead and mixtures thereof. Non-limiting examples of preferred metals for use in the present invention include silver, gold, zinc, tin, copper, nickel, cobalt, rhodium, palladium and platinum—silver, copper and nickel being particularly preferred. The metallic particles and/or metallic nanoparticles optionally comprise a metal selected from the group consisting of silver, gold, zinc, tin, copper, platinum and palladium or a combination thereof. Non-limiting examples of metal-containing compounds or components that exhibit metallic characteristics and that may be useful as metallic particles and/or metallic nanoparticles of the reflective features and inks of the present invention include metal oxides, metal nitrides (e.g., titanium nitride or tantalum nitride), metal sulphides and some semiconductors. The metal-containing compound(s) preferably have a small electronic band gap that gives rise to metallic properties or characteristics. A non-limiting list of exemplary metal oxides includes bronzes such as tungsten bronzes including hydrogen tungsten oxide, sodium tungsten oxide and lithium tungsten oxide as well as other bronzes such as phosphor bronzes. Additional tungsten oxides are described in Published U.S. Patent Application No. 2005/0271566A1, which published Dec. 8, 2005, the entirety of which is incorporated herein by reference. In one aspect, the metallic particles and/or metallic nanoparticles comprise a mineral having a metallic characteristic. A non-limiting list of exemplary minerals suitable for the metallic particles and/or metallic nanoparticles includes marcasites and pyrites. In another embodiment, the metallic particles and/or the metallic nanoparticles comprise an enamel or a glass/metal composite that provides a metallic characteristic. In one embodiment, the metallic particles and/or metallic nanoparticles comprise a pearlescent material and/or an opalescent material that provides a metallic characteristic.

The reflective features of the present invention (as well as the inks used to make, form, print, or create the reflective features of the present invention) also, in one embodiment, comprise mixtures of two or more different metallic particles and/or metallic nanoparticles, optionally with a pigment or a dye. In another embodiment, the reflective features of the present invention comprise metallic particles and/or metallic nanoparticles that comprise two or more metals in the form of an alloy or a mixture of metals or metal containing compounds. Non-limiting examples of alloys useful as metallic particles and/or metallic nanoparticles of the invention include Cu/Zn, Cu/Sn, Ag/Ni, Ag/Cu, Pt/Cu, Ru/Pt, Ir/Pt and Ag/Co. Optionally, the metallic particles and/or nanoparticles comprise an alloy such as bronze, tungsten bronzes or brass. Also, in an embodiment, the metallic particles and/or metallic nanoparticles have a core-shell structure made of two different metals such as, for example, a core comprising nickel and a shell comprising silver (e.g. a nickel core having a diameter of about 20 nm surrounded by an about 15 nm thick silver shell). In another embodiment, the core-shell structure may be comprised of a metal oxide core with another metal oxide coating. A non-limiting example is a nanoparticle core-shell structure comprising a mica core and a titania coating. In another embodiment, the metallic particles and/or metallic nanoparticles comprise metal-effect particles and/or pigments. One method for creating metal effect pigments is to deposit thin layers of one metal oxide or ceramic on the surface of another (e.g. $TiO_2$ on mica). Metal-effect pigments are further described in *CENEAR* Vol. 81, No. 44, pp. 25-27 (Nov. 3, 2003) (ISSN 0009-2347), the entirety of which is incorporated herein by reference.

Metallic particles and/or metallic nanoparticles suitable for use in the reflective features, preferably the reflective security features or reflective decorative features, of the present invention and in the inks, preferably the digital inks, used to form these reflective features can be produced by a number of methods. For example, the metallic particles and/or metallic nanoparticles may be formed by spray pyrolysis, as described, for example, in U.S. Provisional Patent Application No. 60/645,985, filed Jan. 21, 2005, or in an organic matrix, as described in U.S. patent application Ser. No. 11/117,701, filed Apr. 29, 2005, published as US 2006/0083694 A1, the entireties of which are fully incorporated herein by reference. A non-limiting example of one preferred method of making metallic particles and metallic nanoparticles, is known as the polyol process, and is disclosed in U.S. Pat. No. 4,539,041, which is fully incorporated herein by reference. A modification of the polyol process is described in, e.g., P.-Y. Silvert et al., "Preparation of colloidal silver dispersions by the polyol process" Part 1—Synthesis and characterization, J. Mater. Chem., 1996, 6(4), 573-577; Part 2—Mechanism of particle formation, J. Mater. Chem., 1997, 7(2), 293-299, both disclosures of these documents are fully incorporated by reference herein. Briefly, in the polyol process a metal compound is dissolved in, and reduced or partially reduced by a polyol such as, e.g., a glycol, at elevated temperature to afford corresponding metal particles. In the modified polyol process, the reduction is carried out in the presence of a dissolved anti-agglomeration substance, preferably a polymer, most preferably polyvinylpyrrolidone (PVP).

A particularly preferred modification of the polyol process for producing metallic particles, especially metallic nanoparticles, is described in co-pending U.S. Patent Application Ser. Nos. 60/643,577 filed Jan. 14, 2005, 60/643,629 filed Jan. 14, 2005, and 60/643,578 filed Jan. 14, 2005, and Cabot Corporation's Patent Docket numbers 2005A001.2, 2005A002.2, 2005A003.2, which are all herein fully incorporated by reference. In a preferred aspect of a modified polyol process, a dissolved metal compound (e.g., a silver compound such as silver nitrate) is combined with and reduced by a polyol (e.g., ethylene glycol, propylene glycol and the like) at an elevated temperature (e.g., at about 120° C.) and in the presence of a polymer, preferably a heteroatom-containing polymer such as PVP.

The metallic particles and/or metallic nanoparticles, particularly those in the inks used to form the reflective features of the present invention, optionally include an anti-agglomeration substance that inhibits agglomeration of the metallic particles and/or metallic nanoparticles when dispersed in an ink. By way of non-limiting example, particularly preferred polymers for use as an anti-agglomeration substance in the present invention include polymers which comprise monomer units of one or more unsubstituted or substituted N-vinyllactams, preferably those having from about 4 to about 8 ring members such as, e.g., N-vinylcaprolactam, N-vinyl-2-piperidone and N-vinylpyrrolidone. These polymers include homo- and copolymers, and combinations thereof. Other non-limiting examples of polymers which are suitable for use as anti-agglomeration substance in the present invention are disclosed in, e.g., U.S. Patent Application Publication 2004/0182533 A1, which published Sep. 23, 2004, the entire disclosure of which is expressly incorporated by reference herein.

According to a preferred aspect of the present invention, the metallic particles and/or metallic nanoparticles useful in the inks and reflective features of the present invention exhibit a small average particle size, preferably with a narrow particle size distribution. A narrow particle size distribution may be used in direct-write applications or digital printing because it may limit clogging of the orifice of a direct-write device, e.g., an ink jet head or cartridge, by large particles. Narrow particle size distributions also may provide the ability to form features having a high resolution and/or high packing density.

In one embodiment, at least about 70 wt. %, at least about 80 wt. %, at least about 85 wt. %, at least about 90 wt. %, at least about 95 wt. %, or at least about 99 wt. % of the metallic particles and/or metallic nanoparticles useful in the present invention, e.g., in the reflective features, preferably the reflective security features or reflective decorative features, and/or in the inks, preferably the digital inks used to form the reflective features, are substantially spherical in shape. In another embodiment, the metallic particles and/or metallic nanoparticles, are in the range of from about 70 wt. % to about 100 wt. % substantially spherical in shape, e.g., from about 80 wt. % to about 100 wt. % substantially spherical in shape or from about 90 wt. % to about 100 wt. % substantially spherical in shape. In another embodiment, the reflective features and/or the inks used to form the reflective features are substantially free of metallic particles in the form of flakes. Conversely, in other aspects, the reflective features and/or the inks used to form the reflective features comprise metallic particles and/or metallic nanoparticles in the form of flakes, rods, tubes, tetrapods, platelets, needles, discs and/or crystals, optionally in the same weight percents described above with respect to spherical particles.

The present invention will be better understood in view of the following non-limiting examples.

EXAMPLES

Example 1

A reflective feature according to one embodiment of the invention was formed by ink jet printing an ink comprising silver nanoparticles (average particle size=20-80 nm) in a single pass onto Epson photopaper. The ink was deposited on the substrate utilizing a Spectra SE-128 piezo-electric ink jet printing head at 120 volts, 12 μs pulse width and 1.2 μs rise/fall and allowed to dry.

The ink used to form the feature had the formulation shown in Table 1, below.

TABLE 1

SILVER NANOPARTICLE INK JET INK FORMULATION

| Ingredient | Weight Percent |
|---|---|
| Silver Nanoparticles | 20.0 |
| Glycerol | 20.0 |
| Ethanol | 28.0 |
| Ethylene Glycol | 32.0 |

The reflective feature comprised a first element comprising the letters "RE" and a second element comprising a square-shaped "background". The two elements were formed in a single pass of the ink jet head and were thus oriented co-planar with respect to one another. The background element was formed of a plurality of horizontally extending straight lines, each line having a thickness of 50 μm and being separated from adjacent lines by a gap having a width of 50 μm. The "RE" element was oriented at a 45° angle extending from the bottom left to the upper right of the square background and was formed of a plurality of vertically extending straight lines, each line having a thickness of 50 μm and being separated from adjacent lines by a gap having a width of 100 μm.

The reflective feature of Example 1 was then observed at different viewing angles and with a point light source radiating light radiation at the feature at a constant angle of incidence. The feature was also maintained in a constant position. As the viewing angle changed relative to the feature surface, the "RE" element was, at certain viewing angles, clearly visible and distinguishable from the background element. At other viewing angles, The "RE" element was obscured and appeared to completely disappear due to light being reflected off of the second element. Similar obscuring effects were also observed by changing the angle of incidence while maintaining a constant viewing angle and a constant position of the feature and by moving the feature while maintaining a constant angle of incidence and a constant viewing angle.

Example 2

A reflective feature according to another embodiment of the invention was formed by ink jet printing an ink comprising silver nanoparticles (average particle size=20-80 nm) onto Epson photopaper which comprised a colored (yellow) image of a crescent moon and star thereon. The ink of Example 1 was deposited directly over a portion of the colored image and on a portion of the background (the surface of the Epson photopaper) surrounding the colored image utilizing a Spectra SE-128 piezo-electric ink jet printing head at 120 volts, 12 μs pulse width and 1.2 μs rise/fall and allowed to dry.

The reflective feature comprised a first element comprising the letters "MY" printed in Charlemagne Standard Bold font, 18 pt. (about 5 mm height), and a second element comprising a basket weave "background" pattern. The first and second elements each overlapped a portion of the underlying image. The basket weave pattern comprised a checkerboard pattern, each checker of the checkerboard pattern comprising a square formed by a series of parallel lines, each line having a thickness of 50 μm and being separated from adjacent lines by a gap having a width of 50 μm. Each checker square (as well as the lines contained therein) had sides having a length of about 1 mm. The lines in each checker were oriented orthogonally with respect to the lines of an adjacent checker. The two elements were formed in a single pass of the ink jet head and were thus oriented co-planar with respect to one another.

The reflective feature of Example 2 was then observed at different viewing angles and with a point light source radiating light radiation at the feature at a constant angle of incidence. The feature was also maintained in a constant position. As the viewing angle changed relative to the feature surface, the "MY" first element was, at certain viewing angles, clearly visible and distinguishable from the background element. At other viewing angles, The "MY" first element was obscured and appeared to completely disappear due to light being reflected off of the second element. Similar obscuring effects were also observed by changing the angle of incidence while maintaining a constant viewing angle and a constant position of the feature and by moving the feature while maintaining a constant angle of incidence and a constant viewing angle.

While the present invention has been described with reference to exemplary embodiments, it is understood that the words that have been used are words of description and illustration, rather than words of limitation. Changes may be made, within the purview of the appended claims, as presently stated and as amended, without departing from the scope and spirit of the present invention in its aspects. Although the invention has been described herein with reference to particular means, materials, and embodiments, the invention is not intended to be limited to the particulars disclosed herein. Instead, the invention extends to all functionally equivalent structures, methods, and uses, such as are within the scope of the appended claims.

We claim:

1. A process for forming a reflective feature, the process comprising direct write printing ink comprising metallic nanoparticles onto a substrate surface in a design, the design comprising a first element having a first pattern, the first element being at least partially coplanar with a second element having a second pattern, the second element having an overall form of an outline background to an overall form of the first element so that the first element is viewable within the second element, and at least one of the first element and the second element causing incident light to be reflected in an intensity that varies with viewing angle.

2. The process of claim 1, wherein each of the first element and the second element causes incident light to be reflected in an intensity that varies with viewing angle.

3. The process of claim 1, wherein the direct write printing comprises ink jet printing.

4. The process of claim 1, wherein the reflective feature is a security feature.

5. The process of claim 4, wherein the security feature comprises a fingerprint, barcode or personal image.

6. The process of claim 4, wherein the security feature is associated with a banknote.

7. The process of claim 4, wherein the security feature is associated with at least one of a certificate of authenticity, tax stamp, and brand authentication tag.

8. The process of claim 2, wherein the reflective feature is a security feature.

9. The process according to claim 1, wherein at least one of the first element or the second element is translucent.

10. A process for forming a reflective feature, the process comprising direct write printing ink comprising metallic nanoparticles onto a substrate surface in a design, the design comprising a first element having a first pattern, the first element being at least partially coplanar with a second element having a second pattern, the second element having an overall form of an outline background to an overall form of the first element so that the first element is viewable within the second element, at least one of the first element and the second element causing incident light to be reflected in an intensity that varies with viewing angle; and forming an image on at least a portion of at least one of the first element and the second element.

11. The process of claim 10, wherein the image is clearly visible when viewed at a first angle and is at least partially obscured when viewed at a second angle.

12. The process of claim 10, wherein the image is at least partially obscured when viewed at a first angle and is clearly visible when viewed at a second angle.

13. The process of claim 10, wherein the forming an image on at least a portion of at least one of the first element and the second element comprises forming an image on at least a portion of each of the first element and the second element; and the image on the first element is clearly visible when viewed at a first angle and the image on the second element is at least partially obscured when viewed at the first angle.

14. The process of claim 13, wherein the image on the first element is at least partially obstructed when viewed at a second angle and the image on the second element is clearly visible when viewed at the second angle.

15. The process of claim 13, wherein the reflective feature is a security feature.

16. The process of claim 14, wherein the reflective feature is a security feature.

17. A process for forming a reflective feature, the process comprising direct write printing ink comprising metallic nanoparticles onto a substrate surface in a design, the design comprising a first element having a first pattern, the first element being at least partially coplanar with a second element having a second pattern, the second element having an overall form of an outline background to an overall form of the first element so that the first element is viewable within the second element, each of the first element and the second element causing incident light to be reflected in an intensity that varies with view angle; and the intensity that varies is different for each of the first element and second element.

18. The process of claim 17, further comprising forming a third element, wherein the third element is at least partially coplanar with the first element and the second element, the third element causing incident light to be reflected in an intensity that varies with at least one of (i) angle of incidence, (ii) viewing angle, and (iii) position of the reflective feature; and the intensity that varies is different for each of the first element, the second element and the third element.

19. The process of claim 17, further comprising direct write printing the ink as a third element disposed on top of the first element and the second element; the third element causing incident light to be reflected in an intensity that varies with at least one of (i) angle of incidence, (ii) viewing angle, and (iii) position of the reflective feature; and the intensity that varies is different for each of the first element, the second element and the third element.

20. The process of claim 17, wherein at least one of the first element or the second element is translucent.

21. The process of claim 17, further comprising a third element disposed underneath the first element and the second element.

* * * * *